US009829829B2

(12) United States Patent
Shimizu et al.

(10) Patent No.: US 9,829,829 B2
(45) Date of Patent: Nov. 28, 2017

(54) DEVELOPING DEVICE AND IMAGE FORMING APPARATUS PROVIDED WITH SAME

(71) Applicant: KYOCERA Document Solutions Inc., Osaka-shi, Osaka (JP)

(72) Inventors: Tamotsu Shimizu, Osaka (JP); Eiji Gyotoku, Osaka (JP); Akihiro Watanabe, Osaka (JP); Norio Kubo, Osaka (JP); Minoru Wada, Osaka (JP); Ryo Taniguchi, Osaka (JP); Yasushi Imanishi, Osaka (JP); Takahiro Okubo, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 15/456,938

(22) Filed: Mar. 13, 2017

(65) Prior Publication Data

US 2017/0269508 A1 Sep. 21, 2017

(30) Foreign Application Priority Data

Mar. 17, 2016 (JP) ..... 2016-053950

(51) Int. Cl.
*G03G 15/08* (2006.01)
*G03G 15/09* (2006.01)

(52) U.S. Cl.
CPC ..... *G03G 15/0889* (2013.01); *G03G 15/0907* (2013.01)

(58) Field of Classification Search
CPC ..... G03G 15/0889; G03G 15/0907
See application file for complete search history.

(56) References Cited

U.S. PATENT DOCUMENTS 6,829,448 B2 * 12/2004 Ozawa ..... G03G 15/0815 399/267
8,849,166 B2 * 9/2014 Toichi ..... G03G 15/0928 399/282
9,134,653 B2 * 9/2015 Watanabe ..... G03G 15/0907

FOREIGN PATENT DOCUMENTS

JP 4-107586 4/1992

* cited by examiner

*Primary Examiner* — Gregory H Curran
(74) *Attorney, Agent, or Firm* — Gerald E. Hespos; Michael J. Porco; Matthew T. Hespos

(57) ABSTRACT

A developing device includes a developing roller, a conveyor roller, a developer stirring unit and a development bias applying unit. The developing roller is arranged to face a photoconductive drum at a predetermined developing position and supplies the toner. The conveyor roller is arranged to face the developing roller at a predetermined facing position and supplies the developer to the developing roller. The development bias applying unit applies development biases to the first sleeve of the developing roller and the second sleeve of the conveyor roller during a developing operation of developing the electrostatic latent image on the photoconductive drum with the toner. The development bias applying unit applies the development biases such that a shifting electric field to move the toner on the first sleeve of the developing roller toward the second sleeve of the conveyor roller is formed at the facing position during the developing operation.

14 Claims, 15 Drawing Sheets

DEVELOPING DEVICE AND IMAGE FORMING APPARATUS PROVIDED WITH SAME

This application is based on Japanese Patent Application No. 2016-053950 filed with the Japan Patent Office on Mar. 17, 2016, the contents of which are hereby incorporated by reference.

BACKGROUND

The present disclosure relates to a developing device and an image forming apparatus provided with the same.

Conventionally, an electrophotographic image forming apparatus such as a printer or a copier includes a photoconductive drum for carrying an electrostatic latent image, a developing device for developing an electrostatic latent image into a toner image by supplying toner to the photoconductive drum and a transfer device for transferring a toner image from the photoconductive drum to a sheet.

Patent literature 1 discloses a developing roller for supplying toner to a photoconductive drum and a conveyor roller for supplying developer to the developing roller. Further, each of the developing roller and the conveyor roller includes a fixed magnet having a plurality of magnetic poles and a sleeve configured to rotate around the magnet. The developer is supplied from the conveyor roller to the developing roller by a magnetic force generated between a first S pole on the side of the conveyor roller and a first N pole on the side of the developing roller. Further, the developer is collected from the developing roller to the conveyor roller by a magnetic force generated between a second N pole on the side of the developing roller and a second S pole on the side of the conveyor roller.

SUMMARY

A developing device according to one aspect of the present disclosure includes a developing roller, a conveyor roller, a developer stirring unit and a development bias applying unit. The developing roller is arranged to face a photoconductive drum, on a surface of which an electrostatic latent image is to be formed, at a predetermined developing position and supplies the toner to the photoconductive drum. The developing roller includes a fixed first magnet having a plurality of magnetic poles along a circumferential direction and a first sleeve configured to rotate in a first rotational direction around the first magnet and carry developer containing toner having a predetermined polarity and magnetic carrier on a peripheral surface. The conveyor roller is arranged to face the developing roller at a predetermined facing position and supplies the developer to the developing roller. The conveyor roller includes a fixed second magnet having a plurality of magnetic poles along a circumferential direction and a second sleeve configured to rotate in a second rotational direction around the second magnet and carry the developer on a peripheral surface. The developer stirring unit stirs the developer and supplies the developer to the conveyor roller. The development bias applying unit applies development biases, in each of which an alternating-current bias is superimposed on a direct-current bias, to the first sleeve of the developing roller and the second sleeve of the conveyor roller during a developing operation of developing the electrostatic latent image on the photoconductive drum with the toner. The first and second rotational directions are set to be opposite to each other at the facing position. The first magnet includes a first magnetic pole arranged upstream of the facing position in the first rotational direction, and a second magnetic pole arranged downstream of the facing position in the first rotational direction. The second magnet includes a third magnetic pole arranged to face the second magnetic pole of the first magnet on a side upstream of the facing position in the second rotational direction, and a fourth magnetic pole arranged to face the first magnet pole of the first magnet on a side downstream of the facing position in the second rotational direction. The developer supplied from the developer stirring unit to the conveyor roller is transferred from the conveyor roller to the developing roller by a magnetic field formed by the second and third magnetic poles. The developer having passed through the developing position is transferred from the developing roller to the conveyor roller by a magnetic field formed by the first and fourth magnetic poles. The development bias applying unit applies the development biases such that a shifting electric field to move the toner on the first sleeve of the developing roller toward the second sleeve of the conveyor roller is formed at the facing position during the developing operation.

Further, an image forming apparatus according to another aspect of the present disclosure includes the above developing device, the photoconductive drum configured to receive the supply of the toner from the developing device and carry a toner image on the peripheral surface and a transfer unit configured to transfer the toner image from the photoconductive drum to a sheet.

DETAILED DESCRIPTION

Hereinafter, an image forming apparatus 10 according to an embodiment of the present disclosure is described in detail based on the drawings. In this embodiment, a tandem color printer is illustrated as an example of the image forming apparatus. The image forming apparatus may be, for example, a copier, a facsimile machine, a complex machine of these or the like.

Figure 1:
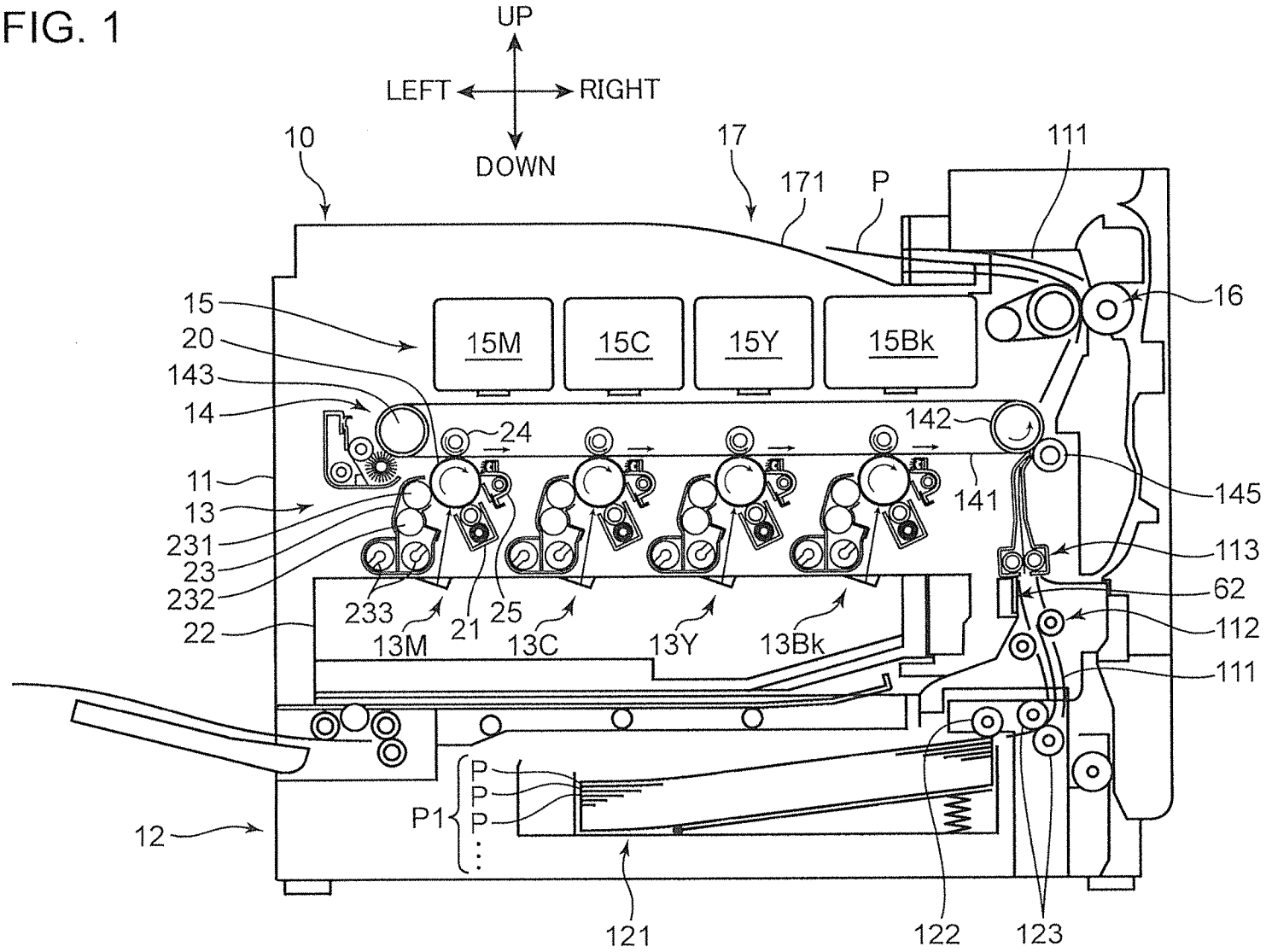
FIG. 1 is a sectional view showing an internal structure of an image forming apparatus according to one embodiment of the present disclosure.

FIG. 1 is a sectional view showing an internal structure of the image forming apparatus 10. This image forming apparatus 10 includes an apparatus body 11 having a box-shaped housing structure. A sheet feeding unit 12 for feeding a sheet P, an image forming station 13 for forming a toner image to be transferred to the sheet P fed from the sheet feeding unit 12, an intermediate transfer unit 14 to which the toner image is to be primarily transferred, a second transfer roller 145, a toner supplying unit 15 for supplying toner to the image forming station 13 and a fixing unit 16 for fixing an unfixed toner image formed on the sheet P to the sheet P are housed in this apparatus body 11. Further, a sheet discharging unit 17 to which the sheet P having a fixing process applied thereto in the fixing unit 16 is to be discharged is provided on a top part of the apparatus body 11.

A sheet conveyance path 111 extending in a vertical direction is formed at a position to the right of the image forming station 13 in the apparatus body 11. A conveyor roller pair 112 for conveying a sheet is disposed at a suitable position of the sheet conveyance path 111. A registration roller pair 113 for correcting the skew of the sheet and feeding the sheet to a secondary transfer nip portion to be described later at a predetermined timing is also provided upstream of the nip portion in the sheet conveyance path 111. The sheet conveyance path 111 is a conveyance path for conveying the sheet P from the sheet feeding unit 12 to the sheet discharging unit 17 by way of the image forming station 13 (secondary transfer nip portion) and the fixing unit 16.

The sheet feeding unit 12 includes a sheet feed tray 121, a pickup roller 122 and a sheet feed roller pair 123. The sheet feed tray 121 is detachably mounted at a lower position of the apparatus body 11 and stores a sheet bundle P1 in which a plurality of sheets P are stacked. The pickup roller 122 picks up the uppermost sheet of the sheet bundle P1 stored in the sheet feed tray 121 one by one. The sheet feed roller pair 123 feeds the sheet P picked up by the pickup roller 122 to the sheet conveyance path 111.

The image forming station 13 is for forming a toner image to be transferred to a sheet P and includes a plurality of image forming units for forming toner images of different colors. As these image forming units, a magenta unit 13 using developer of magenta (M), a cyan unit 13C using developer of cyan (C), a yellow unit 13Y using developer of yellow (Y) and a black unit 13Bk using developer of black (Bk) successively arranged from an upstream side toward a downstream side (from a left side to a right side shown in FIG. 1) in a rotational direction of an intermediate transfer belt 141 to be described later are provided in this embodiment. Each of the units 13M, 13C, 13Y and 13Bk includes a photoconductive drum 20 and a charging device 21, a developing device 23 and a cleaning device 25 arranged around the photoconductive drum 20. Further, an exposure device 22 common to each unit 13M, 13C, 13Y, 13Bk is arranged below the image forming units.

The photoconductive drum 20 is rotationally driven about an axis thereof and an electrostatic latent image and a toner image are formed on a peripheral surface thereof. A photoconductive drum using an amorphous silicon (a-Si) based material can be used as this photoconductive drum 20. Each photoconductive drum 20 is arranged to correspond to the image forming unit of each color. The charging device 21 uniformly charges the surface of the photoconductive drum 20. The charging device 21 includes a charging roller and a charge cleaning brush for removing the toner adhering to the photoconductive drum 20. The exposure device 22 includes various optical devices such as a light source, a polygon mirror, a reflection mirror and a deflection mirror and forms an electrostatic latent image by irradiating light modulated based on image data to the uniformly charged peripheral surface of the photoconductive drum 20. Further, the cleaning device 25 cleans the peripheral surface of the photoconductive drum 20 after the transfer of the toner image.

The developing device 23 supplies the toner to the peripheral surface of the photoconductive drum 20 to develop the electrostatic latent image formed on the photoconductive drum 20. The developing device 23 is for two-component developer composed of toner and carrier. Note that the toner has a property of being positively charged (charged to a predetermined polarity) in this embodiment.

The intermediate transfer unit 14 is arranged in a space provided between the image forming station 13 and the toner supplying unit 15. The intermediate transfer unit 14 includes the intermediate transfer belt 141, a drive roller 142, a driven roller 143 and a primary transfer roller 24.

The intermediate transfer belt 141 is an endless belt-like rotary body and mounted between the drive roller 142 and the driven roller 143 such that a peripheral surface thereof is held in contact with the peripheral surface of each photoconductive drum 20. The intermediate transfer belt 141 is driven to turn in one direction and carries a toner image transferred from the photoconductive drums 20 on a surface.

The drive roller 142 stretches the intermediate transfer belt 141 at a right end side of the intermediate transfer unit 14 and drives and rotates the intermediate transfer belt 141. The drive roller 142 is formed of a metal roller. The driven roller 143 stretches the intermediate transfer belt 141 at a left end side of the intermediate transfer unit 14. The driven roller 143 applies a tension to the intermediate transfer belt 141.

The primary transfer roller 24 forms a primary transfer nip portion by sandwiching the intermediate transfer belt 141 between the primary transfer roller 24 and the photoconductive drum 20 and primarily transfers the toner image on the photoconductive drum 20 onto the intermediate transfer belt 141. Each primary transfer roller 24 is arranged to face the photoconductive drum 20 of each color.

The secondary transfer roller 145 is arranged to face the drive roller 142 across the intermediate transfer belt 141. The secondary transfer roller 145 forms the secondary transfer nip portion by being pressed into contact with the peripheral surface of the intermediate transfer belt 141. The toner image primarily transferred onto the intermediate transfer belt 141 is secondarily transferred to the sheet P supplied from the sheet feeding unit 12 in the secondary transfer nip portion. The intermediate transfer unit 14 and the secondary transfer roller 145 of this embodiment constitute a transfer unit of the present disclosure. The transfer unit transfers the toner image to the sheet P from the photoconductive drums 20.

The toner supplying unit 15 is for storing toner used for image formation and includes a magenta toner container 15M, a cyan toner container 15C, a yellow toner container 15Y and a black toner container 15Bk in this embodiment. These toner containers 15M, 15C, 15Y and 15Bk supply the toner of the respective colors to the developing devices 23 of the image forming units 13M, 13C, 13Y, 13Bk corresponding to the respective colors of MCYBk through unillustrated toner conveying units.

The sheet P supplied to the fixing unit 16 is heated and pressed by passing through a fixing nip portion. In this way, the toner image transferred to the sheet P in the secondary transfer nip portion is fixed to the sheet P.

The sheet discharging unit 17 is formed by recessing a top part of the apparatus body 11 and a sheet discharge tray 171 for receiving the discharged sheet P is formed on a bottom part of this recess. The sheet P having a fixing process applied thereto is discharged to the sheet discharge tray 171 by way of the sheet conveyance path 111 extending from the top of the fixing unit 16.

Figure 2:
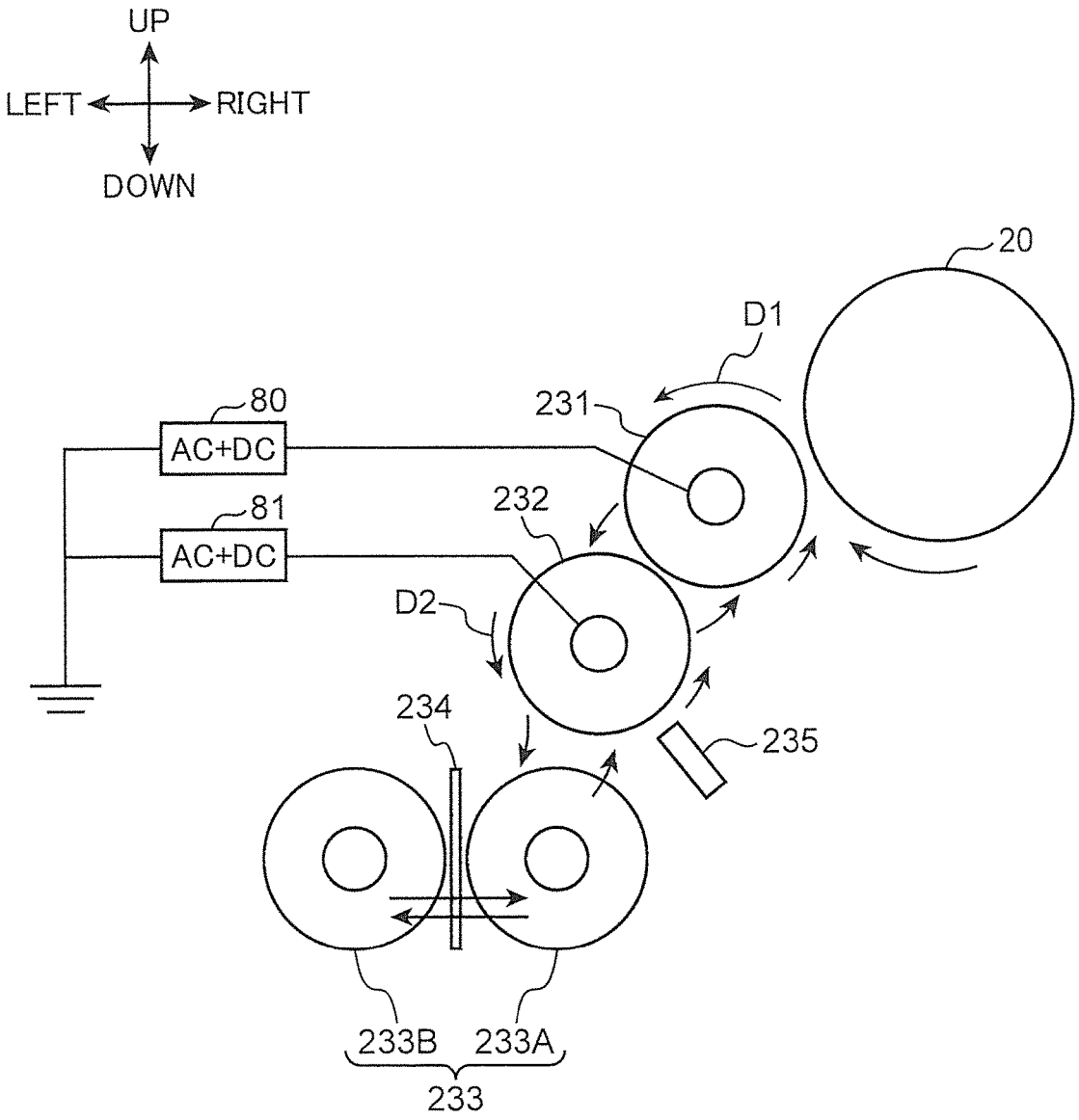
FIG. 2 is a schematic sectional view showing an internal structure of a developing device according to the one embodiment of the present disclosure.
Figure 3:
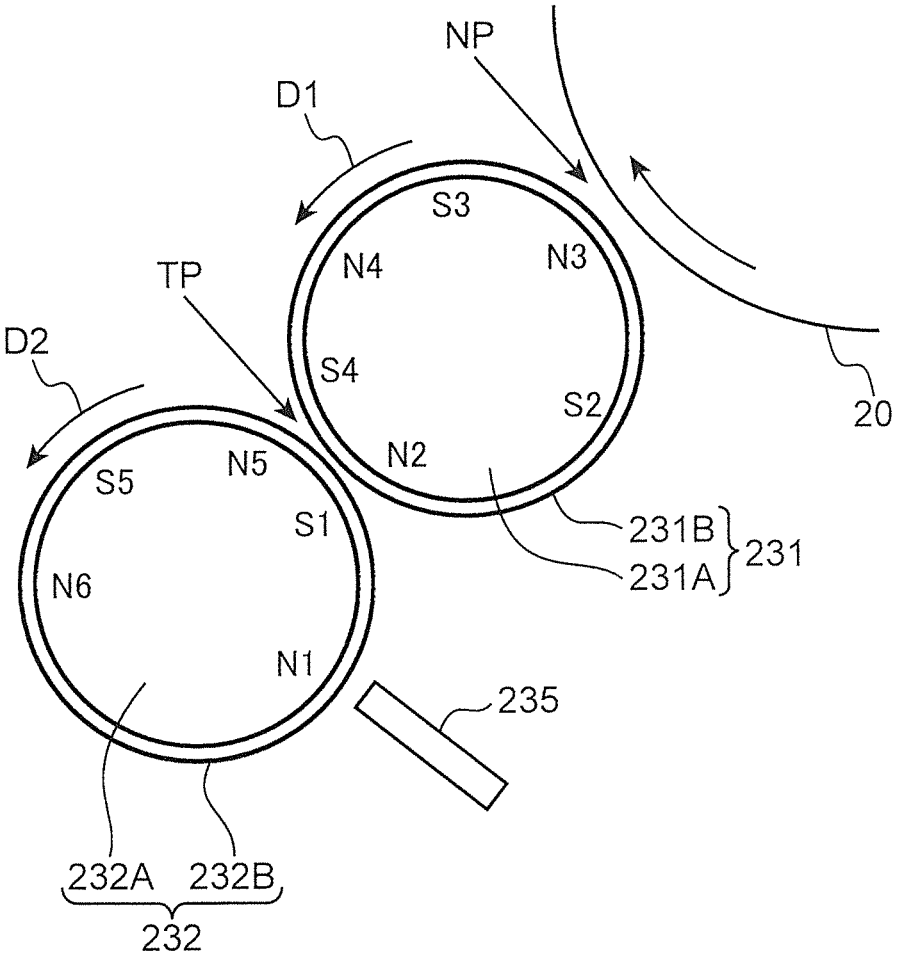
FIG. 3 is a schematic sectional view showing the arrangements of magnetic poles of a developing roller and a conveyor roller according to the one embodiment of the present disclosure.
Figure 4:
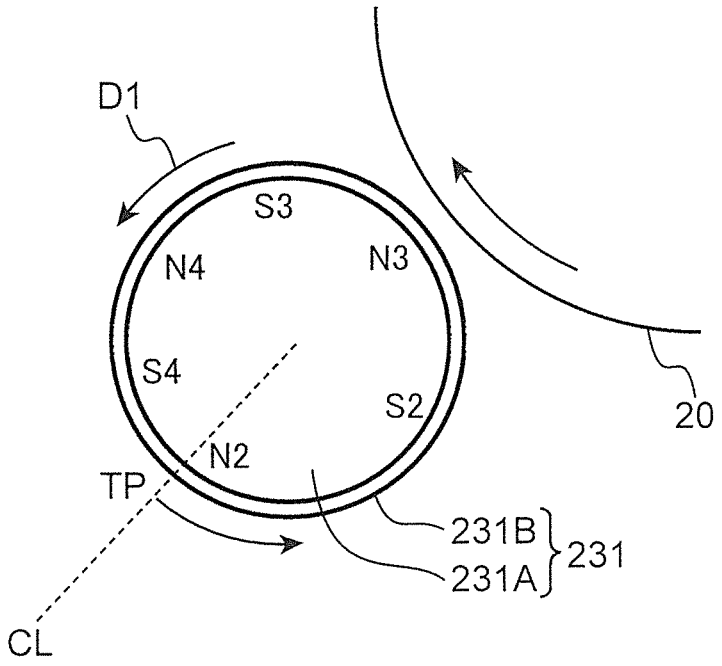
FIG. 4 is a schematic sectional view showing the arrangement of the magnetic poles of the developing roller according to the one embodiment of the present disclosure.
Figure 5:
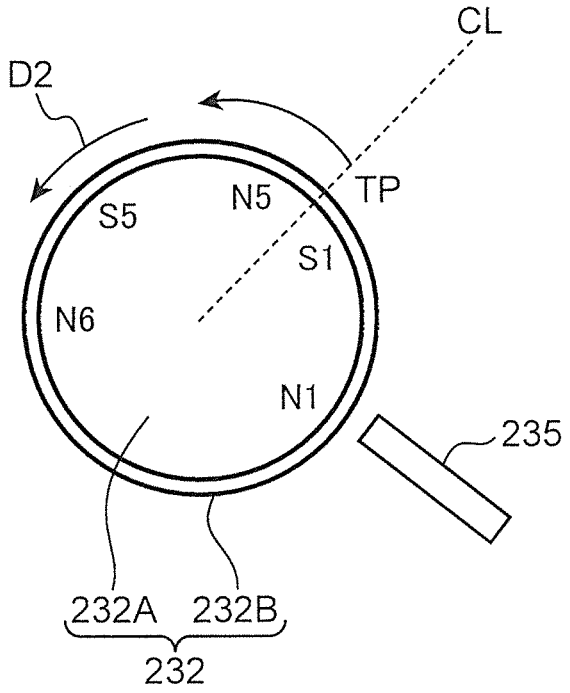
FIG. 5 is a schematic sectional view showing the arrangement of the magnetic poles of the conveyor roller according to the one embodiment of the present disclosure.
Figure 6:
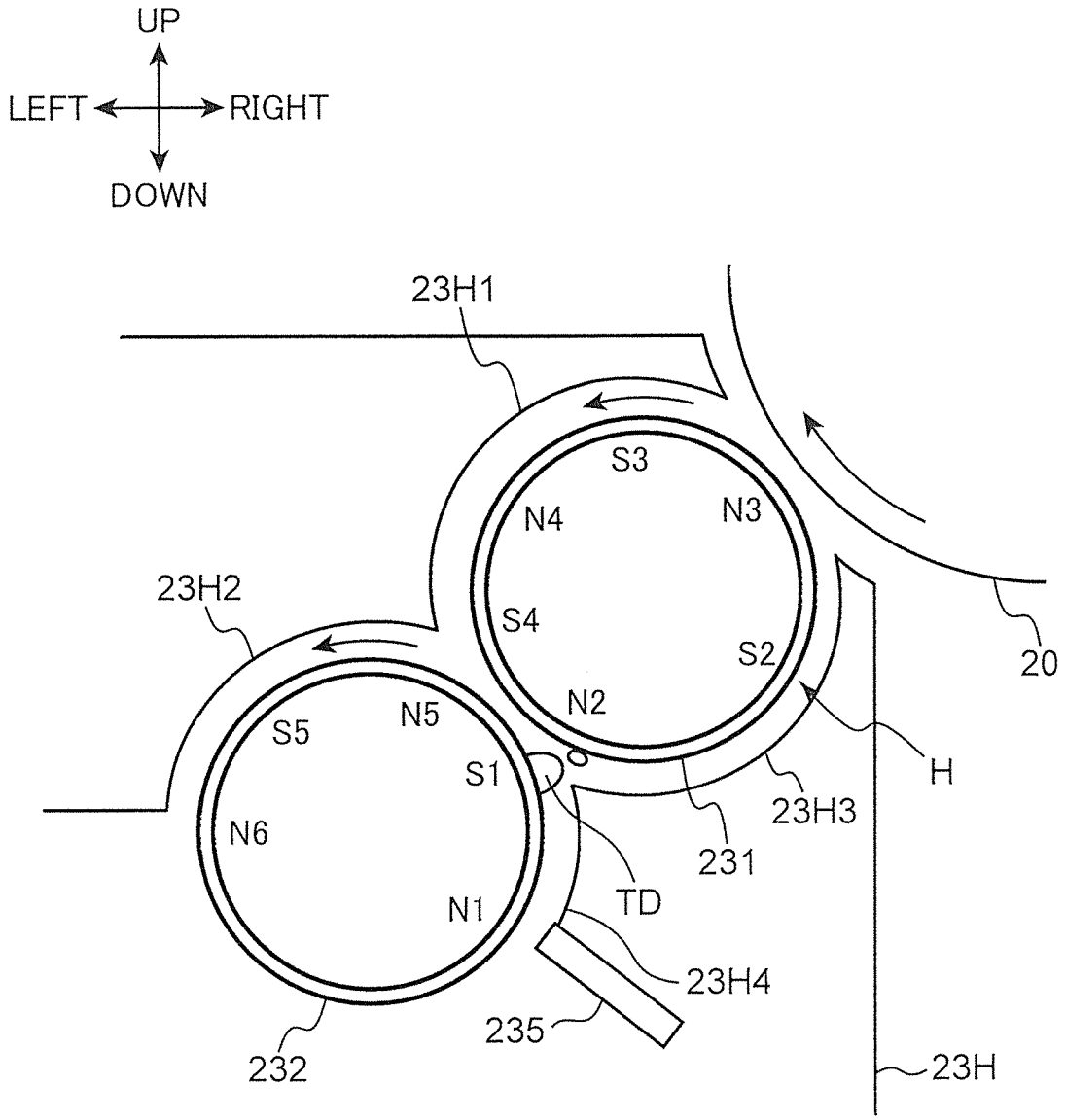
FIG. 6 is a schematic sectional view showing the configuration of a housing in the developing device according to the one embodiment of the present disclosure.

Next, the developing device 23 according to this embodiment is further described in detail with reference to FIGS. 2 to 6 in addition to FIG. 1. FIG. 2 is a schematic sectional view showing an internal structure of the developing device 23 according to this embodiment. In FIG. 2, a rotational direction of each rotary member of the developing device 23 is shown by an arrow. FIG. 3 is a schematic sectional view showing the arrangements of magnetic poles of a developing roller 231 and a conveyor roller 232 according to the this embodiment. FIG. 4 is a schematic sectional view showing the arrangement of the magnetic poles of the developing roller 231. FIG. 5 is a schematic sectional view showing the arrangement of the magnetic poles of the conveyor roller 232. FIG. 6 is a schematic sectional view showing the structure of a housing 23H in the developing device 23 according to this embodiment.

With reference to FIGS. 1 to 6, the developing device 23 includes the housing 23H, the developing roller 231, the conveyor roller 232, a stirring screw 233 (developer stirring unit) with two screws, a partition plate 234 and a layer thickness regulating member 235. The housing 23H is a casing body for supporting each member of the developing device 23.

The developing roller 231 is arranged to face the photoconductive drum 20, on a surface of which an electrostatic latent image is to be formed, at a predetermined developing position NP (FIG. 3) and supplies the toner to the photoconductive drum 20. The developing roller 231 includes a first magnet 231A and a first sleeve 231B (FIG. 3). Note that, in this embodiment, the developing position NP includes a position where the photoconductive drum 20 and the developing roller 231 are closest to each other. The first magnet 231A is a cylindrical magnet including a plurality of magnetic poles along a circumferential direction and fixed to the housing 23H. The first sleeve 231B rotates in a first rotational direction (direction of an arrow D1 in FIGS. 2 and 3) around the first magnet 231A and carries developer containing the toner and magnetic carrier on a peripheral surface. In this embodiment, the first sleeve 231B is formed of a circular pipe member (base member) made of aluminum. Sandblasting (blasting) is applied to the peripheral surface of the circular pipe member of the first sleeve 231B and the circular pipe member includes a Ni plating layer applied on the peripheral surface thereof. A surface of the Ni plating layer of the first sleeve 231B has a predetermined surface roughness. In this embodiment, the surface roughness Rzjis of the first sleeve 231B is set in a range of 4.0 μm to 14.0 μm. The first sleeve 231B of the developing roller 231 is rotatably supported on the housing 23H.

The conveyor roller 232 is arranged to face the developing roller 231 at a predetermined facing position TP (FIG. 3) and supplies the developer to the developing roller 231. Note that, in this embodiment, the facing position TP includes a position where the conveyor roller 232 and the developing roller 231 are closest to each other. The conveyor roller 232 includes a second magnet 232A and a second sleeve 232B. The second magnet 232A includes a plurality of magnetic poles along a circumferential direction and is fixed to the housing 23H. The second sleeve 232B rotates in a second rotational direction (direction of an arrow D2 in FIGS. 2 and 3) around the second magnet 232A and carries the developer containing the toner and the carrier on a peripheral surface. The second sleeve 232B of the conveyor roller 232 is rotatably supported on the housing 23H.

Note that development biases in each of which an AC bias is superimposed on a DC bias are applied to the developing roller 231 and the conveyor roller 232. To this end, the developing device 23 includes a first bias applying unit 80 and a second bias applying unit 81 (both are development bias applying units) (FIG. 2). The first and second bias applying units 80, 81 apply the development biases to the first sleeve 231B of the developing roller 231 and the second sleeve 232B of the conveyor roller 232 during a developing operation of developing an electrostatic latent image on the photoconductive drum 20 with the toner.

Further, as shown in FIG. 3, the first rotational direction D1 of the developing roller 231 and the second rotational direction D2 of the conveyor roller 232 are set to be opposite to each other at the facing position TP (counter directions).

The stirring screw 233 charges the toner by conveying two-component developer in a circulating manner while stirring this developer. The stirring screw 233 includes a first screw 233A and a second screw 233B. Note that although not shown in FIG. 2, the housing 23H includes an unillustrated first stirring portion in which the first screw 233A is arranged and an unillustrated second stirring portion in which the second screw 233B is arranged (see the developing device 23 of FIG. 1). The developer is conveyed in a circulating manner between the first and second screws 233A, 233B. The first screw 233A supplies the developer to the conveyor roller 232. The partition plate 234 is a plate-like member provided in the housing 23H. The partition plate 234 partitions between the first and second stirring portions along axial directions of the first and second screws 233A, 233B. Further, the toner supplied from the toner supplying unit 15 flows into the housing 23H from one axial end side of the second screw 233B and is stirred with the other developer.

The layer thickness regulating member 235 is a plate-like member made of nonmagnetic metal and arranged to face the peripheral surface of the conveyor roller 232. Note that a magnetic member may be fixed to an upstream side surface of the layer thickness regulating member 235 in another embodiment. The layer thickness regulating member 235 regulates a layer thickness of the developer supplied to the conveyor roller 232 from the first screw 233A of the stirring screw 233.

Further, as shown in FIG. 2, an axial center of the developing roller 231 is arranged below that of the photoconductive drum 20 and an axial center of the conveyor roller 232 is arranged further below that of the conveyor roller 231.

Further, with reference to FIG. 2, the developer composed of the toner and the carrier and conveyed in a circulating manner by the stirring screw 233 is supplied from the first screw 233A to the conveyor roller 232. Thereafter, this developer is supplied to the developing roller 231 after the layer thickness of the developer is regulated by the layer thickness regulating member 235. When part of the toner is supplied to the photoconductive drum 20 at the developing position NP (FIG. 3), the developer is collected from the developing roller 231 to the conveyor roller 232. Thereafter, the developer collected to the conveyor roller 232 flows again into the first stirring portion around the first screw 233A.

With reference to FIGS. 3 and 4, the first magnet 231A of the developing roller 231 has six magnetic poles along the circumferential direction. An N2 pole (second magnetic pole) is arranged downstream of the facing position TP between the developing roller 231 and the conveyor roller 232 in the first rotational direction (D1). Further, an S2 pole is arranged downstream of the N2 pole in the first rotational direction. The S2 pole functions as a carrying pole for carrying the developer received from the conveyor roller 232 toward the photoconductive drum 20. Further, an N3 pole functioning as a main pole for supplying the toner to the photoconductive drum 20 is arranged downstream of the S2 pole in the first rotational direction. The N3 pole is arranged near the developing position NP.

Further, the first magnet 231A has three magnetic poles (S3, N4, S4) in a region downstream of the developing position NP in the first rotational direction and upstream of the facing position TP in the first rotational direction. The S3 pole is arranged adjacent to and downstream of the N3 pole in the first rotational direction. The N4 pole is a magnetic pole arranged adjacent to and downstream of the S3 pole in the first rotational direction. The S4 pole (first magnetic pole) is arranged adjacent to and downstream of the N4 pole in the first rotational direction and upstream of the facing position TP in the first rotational direction. Note that the aforementioned N2 pole is arranged downstream of the facing position TP in the first rotational direction with the facing position TP arranged between the S4 and N2 poles.

Table 1 shows a magnet with angles and magnetic forces of six magnetic poles illustrated as the first magnet 231A according to this embodiment. Magnetic flux density of the pole is hereinafter referred to as magnetic force of the pole. Note that the angle of each magnetic pole shown in Table 1 is shown along the first rotational direction with the facing position TP of FIG. 4 as a starting point (angle 0°). Note that a straight line CL connecting the facing position TP and a rotation axis center of the developing roller 231 (straight line connecting the rotation axis center of the developing roller 231 and that of the conveyor roller 232) is shown in FIG. 4.

TABLE 1

| MAGNETIC POLE | MAGNETIC FORCE | ANGLE |
|---|---|---|
| N2 | 54 | 32 |
| S2 | 67 | 83 |
| N3 | 86 | 145 |
| S3 | 64 | 204 |

TABLE 1-continued

| MAGNETIC POLE | MAGNETIC FORCE | ANGLE |
|---|---|---|
| N4 | 48 | 266 |
| S4 | 43 | 330 |

On the other hand, with reference to FIGS. 3 and 5, the second magnet 232A of the conveyor roller 232 has five magnetic poles along the circumferential direction. An N5 pole (fourth magnetic pole) is arranged downstream of the facing position TP between the developing roller 231 and the conveyor roller 232 in the second rotational direction (D2). The N5 pole is arranged to face the S4 pole of the first magnet 231A. Further, an S5 pole is arranged downstream of the N5 pole in the second rotational direction. Furthermore, an N6 pole is arranged downstream of the S5 pole in the second rotational direction. An N1 pole is arranged at a distance from and downstream of the N6 pole in the second rotational direction. The N6 pole functions as a peeling pole for peeling the developer received from the conveyor roller 232. The N1 pole functions as a draw-up pole for drawing up the developer from the first screw 233A. An S1 pole (third magnetic pole) is arranged downstream of the N1 pole in the second rotational direction and upstream of the facing position TP in the second rotational direction. As shown in FIG. 5, the aforementioned layer thickness regulating member 235 is arranged to face at a predetermined distance from the second magnet 232A of the conveyor roller 232 between the S1 and N1 poles on a side upstream of the S1 pole in the second rotational direction, particularly near the N1 pole. Thus, the layer thickness of the developer can be stably regulated before the developer is transferred from the conveyor roller 232 to the developing roller 231. Note that the N5 pole is arranged adjacent to the S11 pole across the facing position TP. Further, the S1 pole is arranged to face the N2 pole of the first magnet 231A.

Table 2 shows angles and magnetic forces (peak values of radial components) of five magnetic poles as an example of the second magnet 232A according to this embodiment. The angle of each magnetic pole shown in Table 2 is shown along the second rotational direction with the facing position TP of FIG. 5 as a starting point (angle 0°). Note that a straight line CL connecting the facing position TP and the rotation axis center of the conveyor roller 232 (straight line connecting the rotation axis center of the developing roller 231 and that of the conveyor roller 232) is shown in FIG. 5.

TABLE 2

| MAGNETIC POLE | MAGNETIC FORCE | ANGLE |
|---|---|---|
| N5 | 53 | 31 |
| S5 | 83 | 92 |
| N6 | 37 | 150 |
| N1 | 48 | 276 |
| S1 | 43 | 328 |

With reference to FIG. 3, the arrangements and functions of the magnetic poles of the first magnet 231A of the developing roller 231 and the second magnet 232A of the conveyor roller 232 are further described. The S4 pole of the first magnet 231A is a magnetic pole arranged to face the N5 pole of the second magnet 232A and having a polarity different from the N5 pole. The developer having passed through the developing position NP is transferred from the developing roller 231 to the conveyor roller 232 by a magnetic field formed by the S4 pole and the N5 pole.

Further, the N2 pole of the first magnet 231A is a magnetic pole having a polarity different from the S4 pole and the S1 pole of the second magnet 232A. The developer supplied from the first screw 233A of the stirring screw 233 to the conveyor roller 232 is transferred from the conveyor roller 232 to the developing roller 231 by a magnetic field formed by the S1 and N2 poles after being regulated by the layer thickness regulating member 235.

With reference to FIG. 6, the housing 23H includes a plurality of inner wall portions facing the developing roller 231 and the conveyor roller 232. Specifically, the housing 23H includes a first inner wall portion 23H1, a second inner wall portion 23H2, a third inner wall portion 23H3 and a fourth inner wall portion 23H4. The first inner wall portion 23H1 faces the S3, N4 and S4 poles and extends along the peripheral surface of the first sleeve 231B of the developing roller 231. The second inner wall portion 23H2 is connected to the first inner wall portion 23H1, faces the N5 and S5 poles and extends along the peripheral surface of the second sleeve 232B of the conveyor roller 232. Similarly, the third inner wall portion 23H3 faces the S2 and N2 poles and extends along the peripheral surface of the first sleeve 231B of the developing roller 231. The first sleeve 231B of the developing roller 231 is arranged to be partially exposed and face the photoconductive drum 20 between the first and third inner wall portions 23H1, 23H3. The fourth inner wall portion 23H4 is connected to the third inner wall portion 23H3, faces the S1 pole and extends along the peripheral surface of the second sleeve 232B of the conveyor roller 232. Note that the layer thickness regulating member 235 is arranged to intersect with the lower end of the fourth inner wall portion 23H4 and extends in a radial direction of the conveyor roller 232 as a longitudinal direction.

Further, as shown in FIG. 6, substantially equal clearances H (conveyance path for the developer) are formed between the respective inner wall portions and the first sleeve 231B of the developing roller 231 and the second sleeve 232B of the conveyor roller 232. In this embodiment, heights of these clearances H are smaller than radii of the developing roller 231 and the developing roller 232 and set in a range of 0.5 mm to 2.0 mm.

Figure 7:
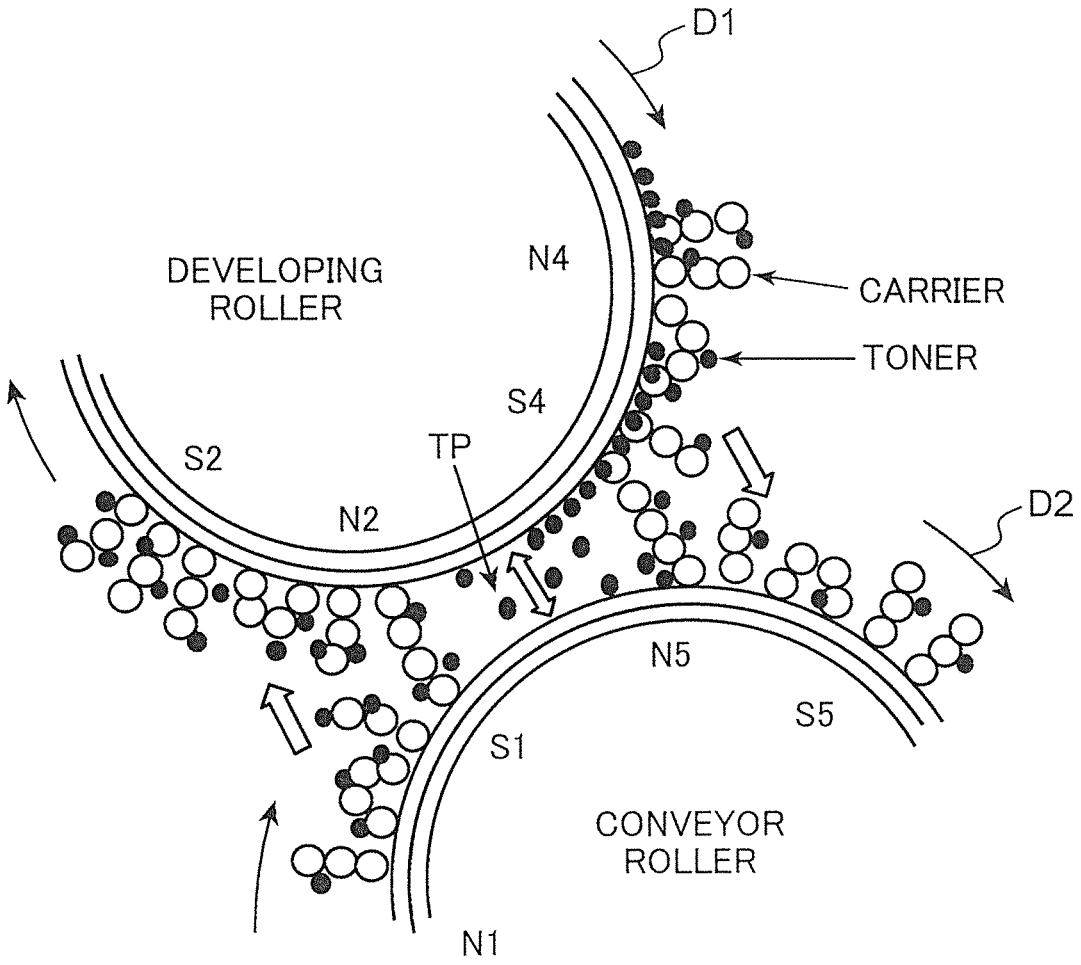
FIG. 7 is a diagram showing a behavior of developer at a facing position in the developing device according to the one embodiment of the present disclosure.
Figure 8:
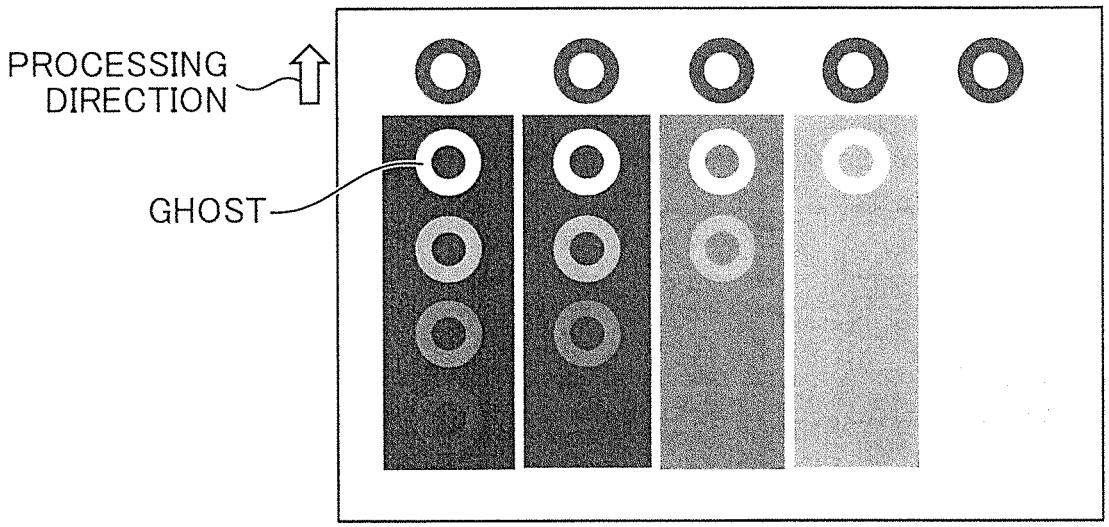
FIG. 8 is a diagram showing a state where ghosts are generated on a print.

FIG. 7 is a diagram showing a behavior of the developer at the facing position TP in the developing device 23 according to this embodiment. Further, FIG. 8 is a diagram showing a state where ghosts are generated on a print. As described above, development biases, in each of which an AC bias is superimposed on a DC bias, are applied to the developing roller 231 and the conveyor roller 232 by the first and second bias applying units 80, 81 (FIG. 2) during the developing operation of developing an electrostatic latent image on the photoconductive drum 20 with the toner. Since an oscillating electric field is formed by the AC bias at the developing position NP (development nip) in this way, fogging toner adhering to a background part on the photoconductive drum 20 can be collected. However, such an oscillating electric field attracts the toner also onto the first sleeve 231B of the developing roller 231. As a result, a toner layer (toner film) is easily formed on the surface of the first sleeve 231B.

A thickness of the toner layer formed on the first sleeve 231B of the developing roller 231 differs between an image part and a background part and this thickness difference remains as a history. FIG. 8 shows ghost images generated on halftone images by such a toner consumption history. A history of ring-shaped images formed on an upstream side in a processing direction (sheet conveying direction) appears on succeeding halftone images. Such a history is based on a toner consumption amount difference in the above toner layer and due to a partial shift of a potential difference between the first sleeve 231B and the photoconductive drum 20 by electric charges of the remaining toner in the next halftone image.

In this embodiment, it is suitably suppressed that the toner layer is formed on the developing roller 231, which is one roller facing the photoconductive drum 20, and ghost images as described above are generated in the developing device 23 in which two magnetic rollers (developing roller 231, conveyor roller 232) are arranged. Specifically, the developing device 23 includes the aforementioned first and second bias applying units 80, 81 to suppress such ghost images. The first and second bias applying units 80, 81 are controlled by an unillustrated bias controller.

In this embodiment, the first and second bias applying units 80, 81 apply the development biases during the developing operation such that a shifting electric field to move the toner on the first sleeve 231B of the developing roller 231 toward the second sleeve 233B of the conveyor roller 232 is formed at the facing position TP. With reference to FIG. 2, the first bias applying unit 80 applies a development bias, in which an AC voltage is superimposed on a DC voltage, to the developing roller 231 as described above. Similarly, the second bias applying unit 81 applies a development bias, in which an AC voltage is superimposed on a DC voltage, to the conveyor roller 232. At this time, when the development biases are applied to rotary shafts of the developing roller 231 and the conveyor roller 232, the above development biases are applied to the first and second sleeves 231B, 232B conductively connected to the respective rotary shafts.

With reference to FIG. 7, the developing operation of the developing device 23 is performed while the developing roller 231 is rotated in the first rotational direction (arrow D1) and the conveyor roller 232 is rotated in the second rotational direction (arrow D2). A pair of developer transfer regions are formed between the developing roller 231 and the conveyor roller 232 at opposite sides of the facing position TP. Specifically, the developer is transferred from the periphery of the S1 pole of the conveyor roller 232 toward the periphery of the N2 pole of the developing roller 231. Further, the developer is transferred from the periphery of the S4 pole of the developing roller 231 toward the periphery of the N5 pole of the conveyor roller 232. As just described, the transfer of the developer between the rollers is mainly done by magnetic fields. Further, the toner is moved from the developing roller 231 to the photoconductive drum 20 by a potential difference between the development bias applied to the developing roller 231 by the first bias applying unit 80 (FIG. 2) and the electrostatic latent image of the photoconductive drum 20 (FIG. 3). Further, as shown in FIG. 7, a potential difference (cleaning bias) for toner collection is provided by the first and second bias applying units 80, 81 at the facing position TP including the closest position of the developing roller 231 and the conveyor roller 232. As a result, a shifting electric field for the toner is formed between the developing roller 231 and the conveyor roller 232 and the toner layer adhering onto the first sleeve 231B of the developing roller 231 is collected toward the conveyor roller 232. Thus, even if the history of the toner consumed at the developing position NP remains in the toner layer on the first sleeve 231B, this toner history is eliminated by the shifting electric field. Thus, the developing device 23 having the generation of ghosts as described above suppressed is provided. Further, even in the case of applying a AC voltage having a high Vpp (inter-peak voltage) to the developing roller 231 to improve the quality of the toner image formed on the photoconductive drum 20, the generation of ghost images is suppressed.

Particularly, when a peak position of a magnetic force is not present at the facing position TP between the developing roller 231 and the conveyor roller 232 as in this embodiment, a polishing force (scraping force) of the magnetic brush of the developer on the conveyor roller 232 is less likely to reach the surface of the first sleeve 231B. Even in such a case, the generation of ghosts can be suppressed by the shifting electric field formed at the facing position TP by the first and second bias applying units 80, 81.

Note that one developing roller 231 is arranged to face the photoconductive drum 20 and develops an electrostatic latent image on the photoconductive drum 20 in this embodiment. Thus, the electrostatic latent image needs to be stably developed at one developing position NP as compared to another developing device in which a plurality of developing rollers are adjacently arranged along the peripheral surface of the photoconductive drum 20. In other words, in the case of arranging the plurality of developing rollers along the rotational direction of the photoconductive drum 20 as described above, a density reduced part of a ghost image formed by the developing roller on an upstream side can be corrected by the developing roller on a downstream side. On the other hand, in this embodiment, if the history of the toner consumption formed on the first sleeve 231B of the developing roller 231 becomes a ghost image during the next rotation, it is difficult to correct. Thus, the next rotation of the history of the toner layer toward the developing position NP can be suitably suppressed by forming the shifting electric field at the facing position TP as described above. As a result, the complication of the structure of the developing device 23 is suppressed and a cost increase of the developing device 23 is suppressed.

Here, the stronger the electric field (shifting electric field) formed between the developing roller 231 and the conveyor roller 232, the higher an effect of collecting the toner layer from the developing roller 231 to the conveyor roller 232. Further, even if the same electric field is formed, a higher effect is obtained as the gap between the developing roller 231 and the conveyor roller 232 becomes narrower. This is because the narrower the gap between the both rollers, the more active the reciprocal movements of the toner between the developing roller 231 and the conveyor roller 232. Since the toner adhering to the first sleeve 231B of the developing roller 231 is driven away by the reciprocating toner, a larger amount of the toner is collected toward the conveyor roller 232. Thus, as described above, the gap between the developing roller 231 and the conveyor roller 232 at the facing position TP is desirably set to be narrower than the gap between the photoconductive drum 20 and the developing roller 231 at the developing roller NP. In this case, the transfer of the developer between the developing roller 231 and the conveyor roller 232 and the collection of the toner layer from the developing roller 231 to the conveyor roller 232 can be stably performed. Note that, in this embodiment, the gap between the developing roller 231 and the photoconductive drum 20 (developing position NP) is set to be larger than 0.25 mm and not larger than 0.40 mm as an example. On the other hand, the gap between the developing roller 231 and the conveyor roller 232 (facing position TP) is set to be not smaller than 0.18 mm and not larger than 0.25 mm.

Further, the peak position of none of the magnetic poles is facing the facing position TP as described above. Thus, even if the gap of the facing position TP is set to be narrow as described above, it is suppressed that the developer present at the facing position TP is fixed. Further, since two magnetic brushes of the developer for transfer are formed across the facing position TP in the circumferential direction, even if the toner is collected by the shifting electric field at the facing position TP, this toner can be confined. Therefore, the scattering of the collected toner from the conveyor roller 232 is suppressed.

Further, in this embodiment, the layer thickness regulating member 235 is arranged to face the conveyor roller 232 and regulates the layer thickness of the developer supplied from the stirring screw 233 to the conveyor roller 232. Thus, a conveyance amount of the developer can be regulated before the developer is transferred from the conveyor roller 232 to the developing roller 231. Further, according to this configuration, it is suppressed that a large amount of the developer is conveyed to the periphery of the facing position TP as compared to the case where the layer thickness regulating member 235 is arranged to face the developing roller 231. As a result, a load applied to the developer around the facing position TP is reduced. Further, a clearance is easily formed at the facing position TP of FIG. 7 and the toner of the toner layer with the remaining history on the first sleeve 231B can be stably collected toward the conveyor roller 232. Specifically, in the configuration shown in FIG. 7, a region where the developer is transferred from the conveyor roller 232 to the developing roller 231 by the magnetic field formed by the N1 and N2 poles is arranged at a position at a distance from a region where the toner is moved from the first sleeve 231B of the developing roller 231 to the second sleeve 232B of the conveyor roller 232 by the shifting electric field formed by the development biases applied by the first and second bias applying units 80, 81 on the peripheral surfaces of the first and second sleeves 231B, 232B. Further, a region where the developer is transferred from the developing roller 231 to the conveyor roller 232 by the magnetic field formed by the S4 and N5 poles is arranged at a position at a distance from the region where the toner is moved from the first sleeve 231B of the developing roller 231 to the second sleeve 232B of the conveyor roller 232 by the shifting electric field formed by the development biases applied by the first and second bias applying units 80, 81 on the peripheral surfaces of the first and second sleeves 231B, 232B.

Furthermore, in this embodiment, an insulating layer is provided on the surface of the second sleeve 232B of the conveyor roller 232. Particularly, the second sleeve 232B includes a circular pipe-like base member made of aluminum and the above insulating layer is an alumite layer formed on the base member of the second sleeve 232B. If a large potential difference is provided between the developing roller 231 and the conveyor roller 232 to form the shifting electric field at the facing position TP, leakage occurs between the both rollers. Thus, in the developing device 23 of the image forming apparatus 10, the first and second bias applying units 80, 81 need to set the development biases within such a range that the above leakage does not occur. On the other hand, if the insulating layer is provided on the surface of the first sleeve 232B, this insulating layer functions as a resistance layer. Thus, a leakage generation voltage generated at the facing position TP is easily stabilized. As a result, a potential difference can be provided at the facing position TP within such a range as not to reach the leakage generation voltage. Further, according to the above configuration, the insulating layer can be easily formed by applying an alumite treatment to the base member of the second sleeve 232B.

Further, in this embodiment, the developer can be stably transferred from the developing roller 231 to the conveyor roller 232 by arranging the N5 pole having a polarity different from the S4 pole as shown in FIG. 6. At this time, since the first and second inner wall portions 23H1, 23H2 are connected to each other while being formed along the peripheral surfaces of the developing roller 231 and the conveyor roller 232, the developer can be smoothly transferred from the developing roller 231 to the conveyor roller 232. Further, with reference to FIG. 6, the axial center of the developing roller 231 is arranged below that of the photoconductive drum 20 and the axial center of the conveyor roller 232 is arranged below that of the developing roller 231. Thus, coupled with a gravitational action, the developer is stably transferred from the periphery of the S4 pole of the developing roller 231 to the periphery of the N5 pole of the conveyor roller 232.

Note that if the magnetic poles having the same polarity are arranged along the first rotational direction in the first magnet 231A of the developing roller 231, a repulsive magnetic field is formed, whereby a retention portion of the developer is formed on the first sleeve 231B. In this case, the toner layer on the first sleeve 231B is expected to be polished by a magnetic brush of the developer slipping at this retention portion. However, since the polarities of the respective magnetic poles of the first magnet 231A are alternately different along the first rotational direction and the magnetic poles having the same polarity are not adjacently arranged in this embodiment as shown in FIG. 3, it is difficult to form the retention portion as described above. Thus, in this embodiment, the toner consumption history on the first sleeve 231B can be eliminated by forming a shifting electric field between the developing roller 231 and the conveyor roller 232 during the developing operation.

Figure 9:
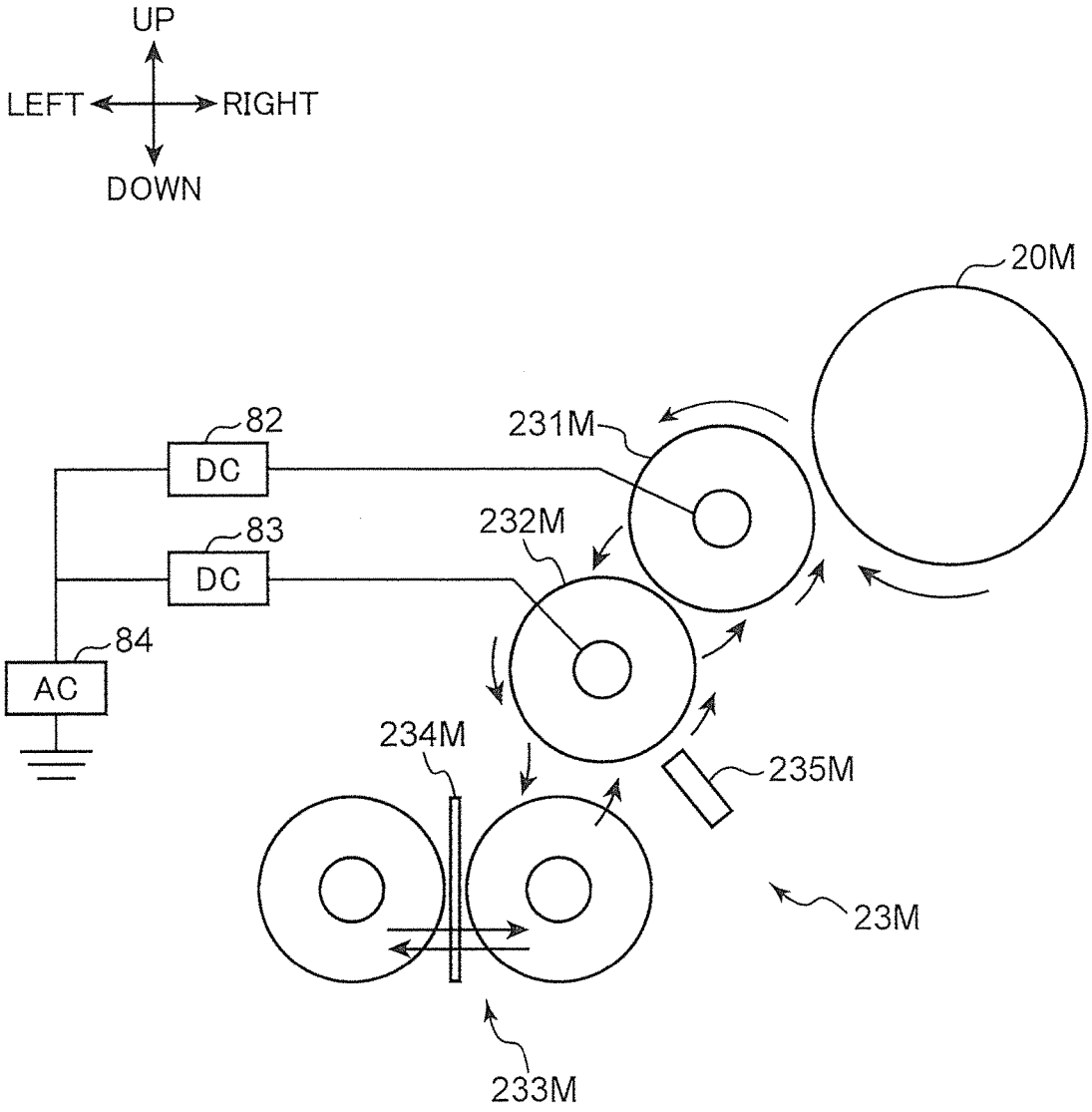
FIG. 9 is a schematic sectional view of a developing device according to a modification of the present disclosure.
Figure 10:
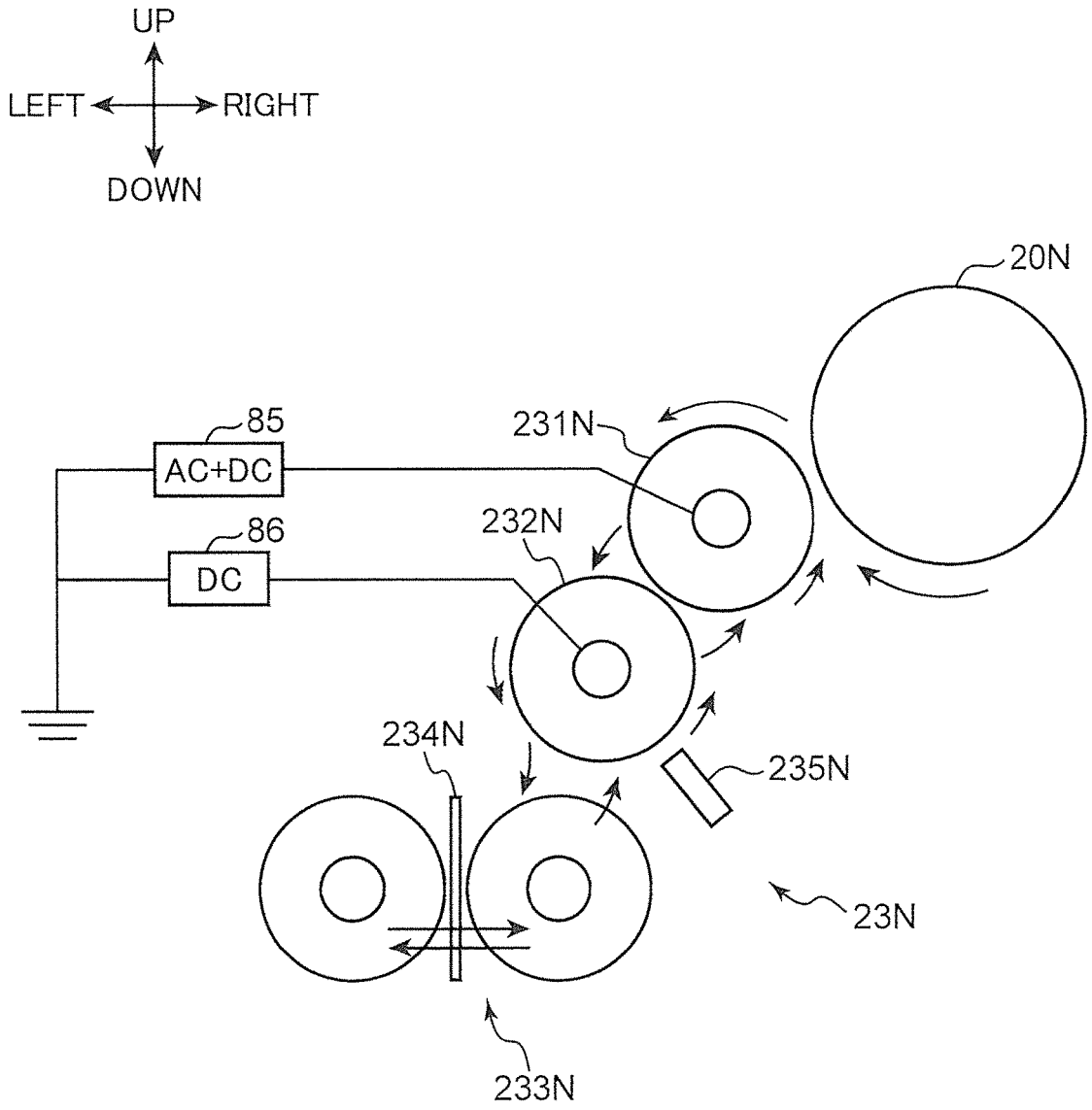
FIG. 10 is a schematic sectional view of a developing device according to a modification of the present disclosure.
Figure 11:
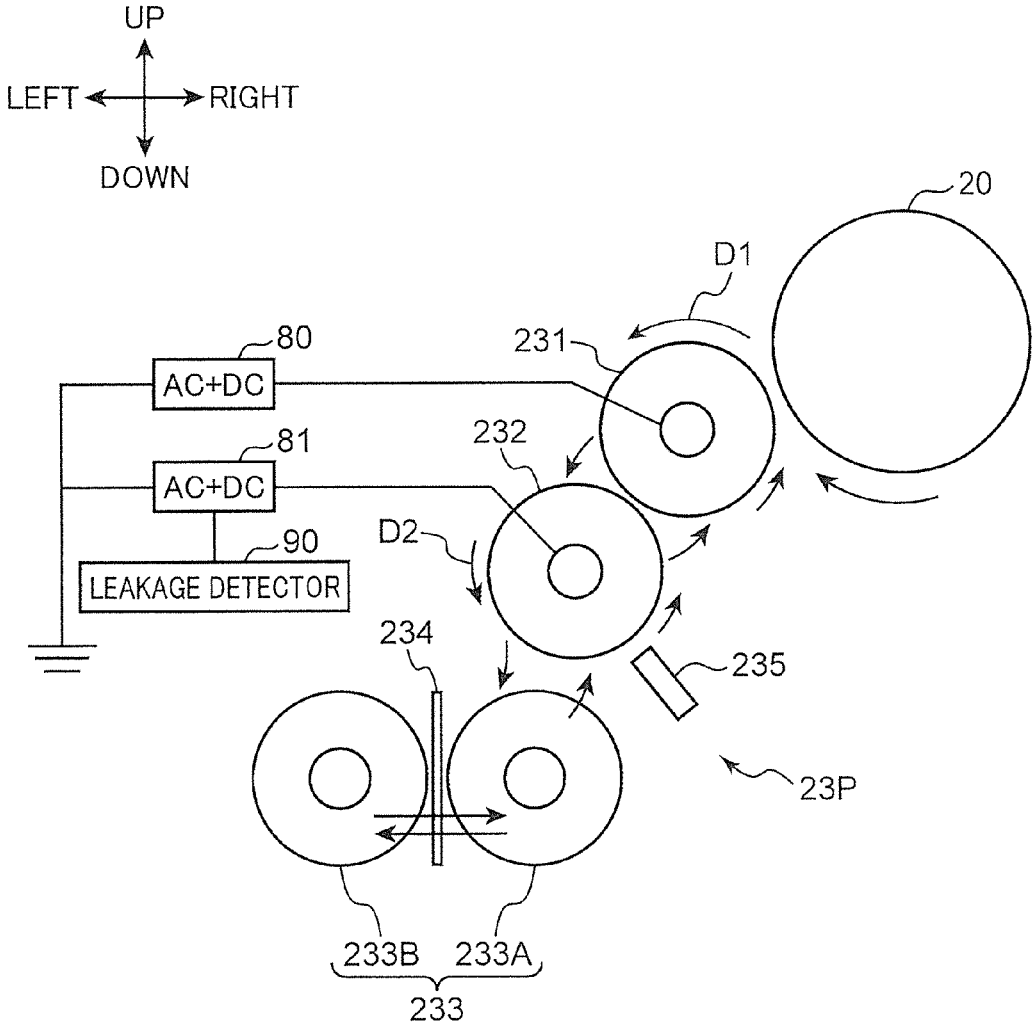
FIG. 11 is a schematic sectional view of a developing device according to a modification of the present disclosure.
Figure 12A:
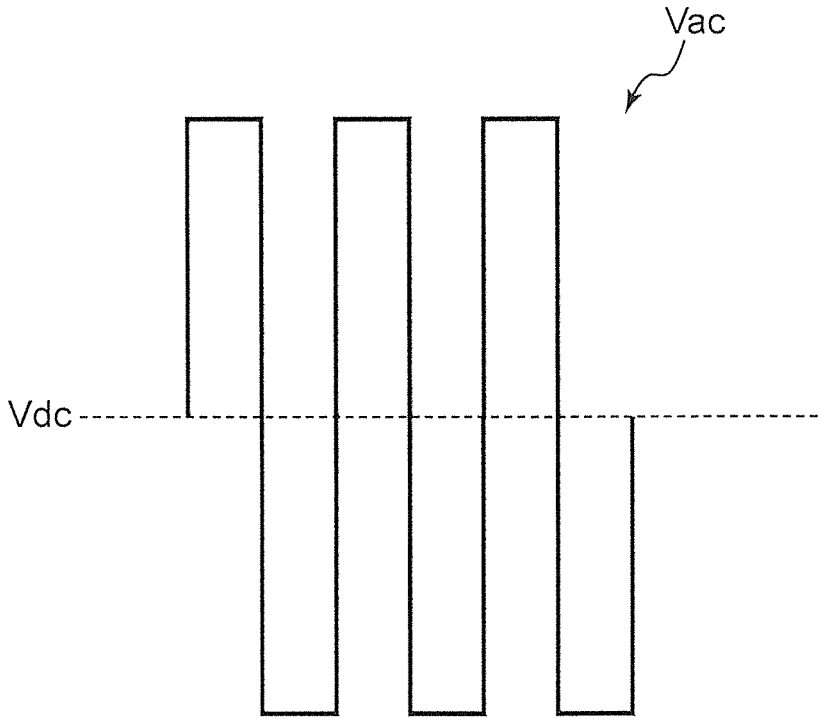
FIG. 12A is a diagram showing a waveform of an AC voltage generated at the facing position of the developing device according to the one embodiment of the present disclosure.
Figure 12B:
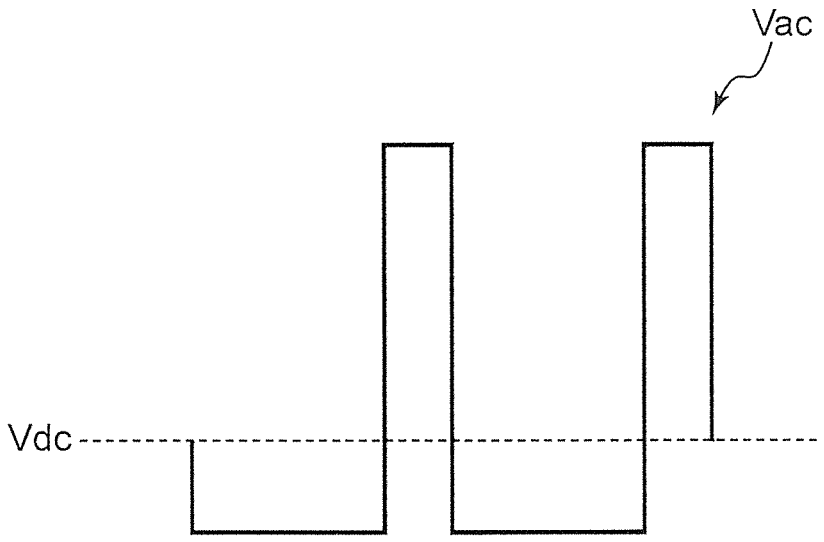
FIG. 12B is a diagram showing a waveform of an AC voltage generated at the facing position of the developing device according to the one embodiment of the present disclosure.

FIG. 9 is a schematic sectional view of a developing device 23M according to a modification of the present disclosure. FIG. 10 is a schematic sectional view of a developing device 23N according to a modification of the present disclosure. FIG. 11 is a schematic sectional view of a developing device 23P according to a modification of the present disclosure. Note that, for members having the same functions as in the above embodiment (FIG. 6), M, N and P are added to the ends of the reference signs of FIG. 6 in FIGS. 9, 10 and 11. Further, FIGS. 12A and 12B are diagrams showing waveforms of AC voltages generated at the facing position TP of the developing device 23 according to this embodiment.

To form a shifting electric field according to the present disclosure at the facing position TP (FIG. 6), the first and second bias applying units 80, 81 are respectively connected to the developing roller 231 and the conveyor roller 232 in the developing device 23 shown in FIG. 2. According to this configuration, individual AC voltages can be applied between the developing roller 231 and the photoconductive drum 20 (developing position NP) and between the developing roller 231 and the conveyor roller 232 (facing position TP). Thus, a bias for forming the shifting electric field at the facing position TP and a bias for supplying the toner to the photoconductive drum 20 can be independently set. Therefore, a degree of freedom in setting conditions of the development biases during the developing operation is expanded.

On the other hand, in FIG. 9, a third bias applying unit 82 (development bias applying unit) composed of a DC power supply is connected to a developing roller 231M and a fourth bias applying unit 83 (development bias applying unit) composed of a DC power supply is connected to a conveyor roller 232M. Further, a fifth bias applying unit 84 (development bias applying unit) composed of an AC power supply is connected to the third and fourth bias applying units 82, 83. In this case, a potential difference composed of a DC voltage is provided and a shifting electric field can be formed at the facing position TP. Also in this case, the generation of ghosts can be reduced as compared to the case where no shifting electric field is formed at the facing position TP during the developing operation.

Further, in FIG. 10, a sixth bias applying unit 85 (development bias applying unit) composed of DC and AC power supplies is connected to a developing roller 231N and a seventh bias applying unit 86 (development bias applying unit) composed of a DC power supply is connected to a conveyor roller 232N. In this case, potential differences composed of a DC voltage and an AC voltage are provided and a shifting electric field can be formed at the facing position TP. Thus, the generation of ghosts can be further reduced as compared to the case where no shifting electric field is formed at the facing position TP during the developing operation. Note that a shifting electric field may be formed at the facing position TP by providing a potential difference composed of a DC voltage.

In forming a shifting electric field at the facing position TP, the larger a potential difference Vpp (inter-peak voltage) of the AC voltage between the developing roller 231 and the developing roller 232 and the larger the potential difference of the DC voltage, the higher a toner layer collecting effect. However, if the potential difference is too large, leakage is likely to occur between the developing roller 231 and the conveyor roller 232. This leakage may occur through the transferred developer or at the closest position of the both facing rollers. Further, a leakage generation voltage changes also depending on a toner density and a surrounding environment (temperature and humidity).

Thus, in FIG. 11, the developing device 23P includes a leakage detector 90. The leakage detector 90 is controlled by an unillustrated controller. The controller monitors a current of a second bias applying unit 81 and causes leakage to occur on a trial basis while gradually increasing Vpp applied to the conveyor roller 232 or a potential difference of a DC voltage during a non-developing operation different from the developing operation. By performing such a leakage detecting operation, it is possible to know a leakage generation voltage in advance and set the development biases during the developing operation at the leakage generation voltage or lower.

This leakage detecting operation is desirably performed before the start of use for printing such as during the manufacturing of the image forming apparatus 10 or during the setup of image quality, but the occurrence of leakage can be detected by monitoring the current of the second bias applying unit 81 even during the use of the image forming apparatus 10. Further, if leakage is detected during the use of the image forming apparatus 10, it is desirable to set the development biases applied to the developing roller 231 and the conveyor roller 232 again by temporarily reducing the value of the current or transitioning into a detailed leakage detection mode. Further, to avoid such a trouble, it is desirable to transition to a detection mode upon receiving a certain trigger signal during an image forming operation. In this case, high cleaning performance can be ensured.

Note that the leakage can be detected by a current on the side of the developing roller 231 or by a current on the side of the conveyor roller 232. Further, unlike in FIG. 11, leakage may be detected by a current flowing from the first bias applying unit 80 on the side of the developing roller 231. In this case, leakage occurring between the developing roller 231 and the photoconductive drum 20 can be separately detected. Further, the value of the potential difference (cleaning bias) for forming the shifting electric field may be changed between sheets or may be changed according to durability (number of prints) and a surrounding environment.

Further, in the case of applying an AC voltage for the potential difference provided at the facing position TP, an AC voltage having a duty ratio of 50% may be applied as shown in FIG. 12A or the duty ratio may be changed from 50% as shown in FIG. 12B. As an example, in FIG. 12B, a duty ratio of the polarity by which the toner is attracted toward the conveyor roller 232 (e.g. 30%) is set to be lower than a duty ratio of the polarity by which the toner is attracted toward the developing roller 231 (e.g. 70%) to form a strong electric field in a direction in which the toner on the developing roller 231 moves toward the conveyor roller 232. In other words, the first and second bias applying units 80, 81 of FIG. 2 apply an AC voltage having a first duty ratio to the developing roller 231 and apply an AC voltage having a second duty ratio different from the first duty ratio between the first and second sleeves 231B, 232B, thereby forming a shifting electric field at the facing position TP. Thus, a stronger shifting electric field can be formed at the facing position TP.

Further, with reference to FIG. 7, if a strong voltage (bias) is applied between the developing roller 231 and the conveyor roller 232, leakage may possibly occur between the both rollers through the carrier in the developer. Thus, it is normally difficult to use carrier having a low electrical resistance. However, since a variation of the leakage generation voltage is suppressed if the alumite layer is formed on the second sleeve 232B as described above, the occurrence of leakage during use (during the developing operation) can be reduced. Further, it is assumed to use carrier having a high electrical resistance in order to reduce the occurrence of leakage. However, in the case of using carrier having a high electrical resistance, developing performance is reduced at the developing position NP. Thus, a reduction of the leakage and the ensuring of an image density need to be balanced.

Figure 13:
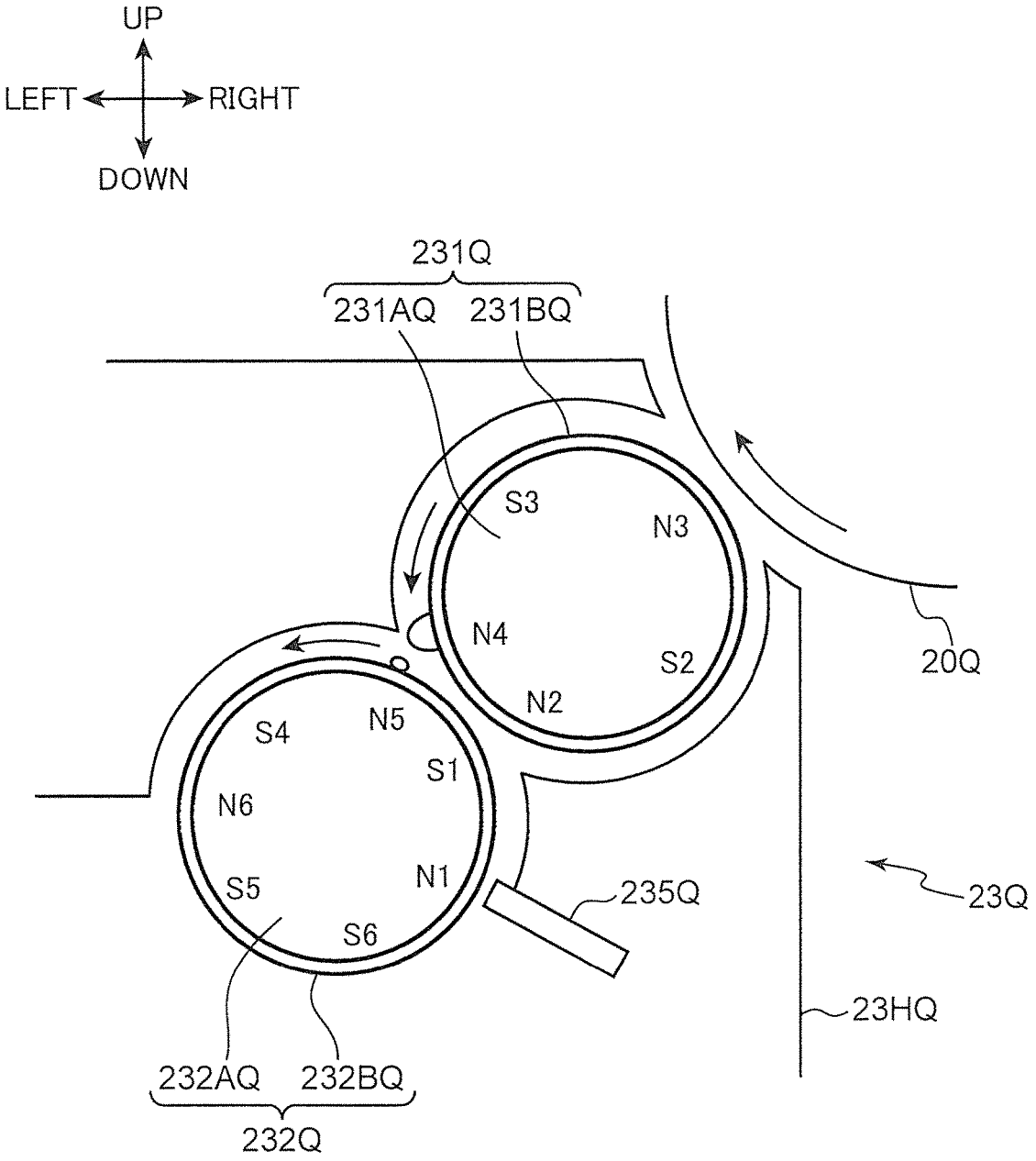
FIG. 13 is a schematic sectional view of a developing device according to a modification of the present disclosure.

FIG. 13 is a schematic sectional view of a developing device 23Q according to a modification of the present disclosure with this point in mind. In this modification, the developer is transferred from a developing roller 231Q to a conveyor roller 232Q between magnetic poles having the same polarity (N4 and N5 poles) as compared to the above embodiment. Note that, for members having the same functions as in the above embodiment (FIG. 6), Q is added to the ends of the reference signs of FIG. 6 in FIG. 13.

If the magnetic poles having the same polarity are used to transfer the developer between the developing roller 231Q and the conveyor roller 232Q in this way, the developer is transferred while the carrier in the developer is flying through a repulsive magnetic field. Thus, a magnetic brush of the developer is less likely to be bridged between the both rollers. As a result, the occurrence of leakage between the both rollers through the carrier is further reduced. In other words, even in the case of using carrier having a low electrical resistance, leakage is less likely to occur through the carrier. Note that this transfer of the developer between the magnetic poles having the same polarity may be made from the developing roller 231 to the conveyor roller 232 or from the conveyor roller 232 to the developing roller 231. However, it is desirably applied for the transfer of the developer from the developing roller 231 to the conveyor roller 232 as shown in FIG. 13. Thus, leakage is likely to occur in a developer transfer region from the developing roller 231 to the conveyor roller 232 and a leakage reducing effect by the magnetic poles having the same polarity is particularly exhibited. Note that an N pole may be arranged on the side of the conveyor roller 232Q and an S pole may be arranged on the side of the developing roller 231Q in the developer transfer region of FIG. 13 from the conveyor roller 232Q to the developing roller 231Q.

EXAMPLES

Next, the present disclosure is further described on the basis of examples. These experiments were conducted under the following experimental conditions. Note that the present disclosure is not limited to the following examples.

<Experimental Conditions>

Photoconductive drum 20: amorphous silicon photoconductor (a-Si) having a diameter ϕ of 30 mm, a surface potential (blank part Vo)=270 V, a surface potential (image part V1)=20 V and a circumferential speed=300 mm/sec (printing of 55 sheets per min)

Gap between layer thickness regulating member 235 and second sleeve 232B: 200 to 600 μm Developer conveyance amount (after layer thickness regulation) on developing roller 231: 250 g/m$^2$ Carrier: ferrite resin coated carrier having a volume average particle diameter of 35 μm and a magnetic force of 80 emu/g Toner: a volume average particle diameter of 6.8 μm, a toner density of 7%

Conditions of the developing roller 231 used in the experiments are as follows.

Developing roller 231: a diameter ϕ of 20 mm

Circumferential speed ratio of the developing roller 231 to photoconductive drum 20: 1.8

Gap between developing roller 231 and photoconductive drum 20: 350 μm

Surface conditions of first sleeve 231B: Sandblasting (Rzjis=7 μm)

AC voltage condition of development bias applied to developing roller 231: a frequency of 3.7 kHz.

Further, a magnetic pole condition of the developing roller 231 used in the experiments is as shown in the previous Table 1. Note that a magnetic force measurement of the developing roller 231 and the conveyor roller 232 was conducted using a GAUSS METER Model GX-100 produced by Nihon Denji Sokki Co., Ltd.

Further, conditions of the conveyor roller 232 used in the experiments are as follows.

Conveyor roller 232: a diameter ϕ of 20 mm

Surface conditions of second sleeve 232B: knurled V grooves (groove depth of 80 μm, groove width of 0.2 mm, the number of grooves of 120), base member made of aluminum and having an alumite layer on a surface Circumferential speed ratio of conveyor roller 232 to developing roller 231: 1.4

Gap between conveyor roller 232 and developing roller 231: 300 μm

Further, a magnetic pole condition of the conveyor roller 232 used in the experiments is as shown in the previous Table 2.

Table 3 shows evaluation results on development ghosts (ghost images) under the above respective conditions with the potential difference between the developing roller 231 and the conveyor roller 232 (facing position TP) changed.

TABLE 3

| EXPERIMENT NO. | DEVELOPMENT BIAS FOR DEVELOPING ROLLER AC Vpp (V) | Duty (%) | DC Vdc (V) | POTENTIAL DIFFERENCE BETWEEN ROLLERS AC Vpp (V) | Duty (%) | DC Vdc (V) | IMAGE EVALUATION NUMBER OF GHOSTS (GHOSTS/A4) |
|---|---|---|---|---|---|---|---|
| 1 | 1200 | 50 | 170 | 0 | 50 | 0 | 15 |
| 2 | 1200 | 50 | 170 | 0 | 50 | −500 | 12 |
| 3 | 1200 | 50 | 170 | 1200 | 50 | −300 | 8 |
| 4 | 1200 | 50 | 170 | 1600 | 50 | −300 | 5 |
| 5 | 1200 | 50 | 170 | 1600 | 31 | −300 | 0 |

Note that, in a development ghost image evaluation, a ghost confirmation pattern image (A4) shown in FIG. 8 was printed and an evaluation was made based on the number of generated ghosts. In the ghost confirmation pattern, five patterns (doughnut-shaped original images) are juxtaposed in a horizontal direction and halftone images are formed behind them. Five patterns of the halftone images respectively differed in density and how many ghosts were generated in each halftone part was evaluated. The ghosts are counted up to the fourth turn from the original image and a maximum of 20 ghosts are generated per print.

Figure 14:
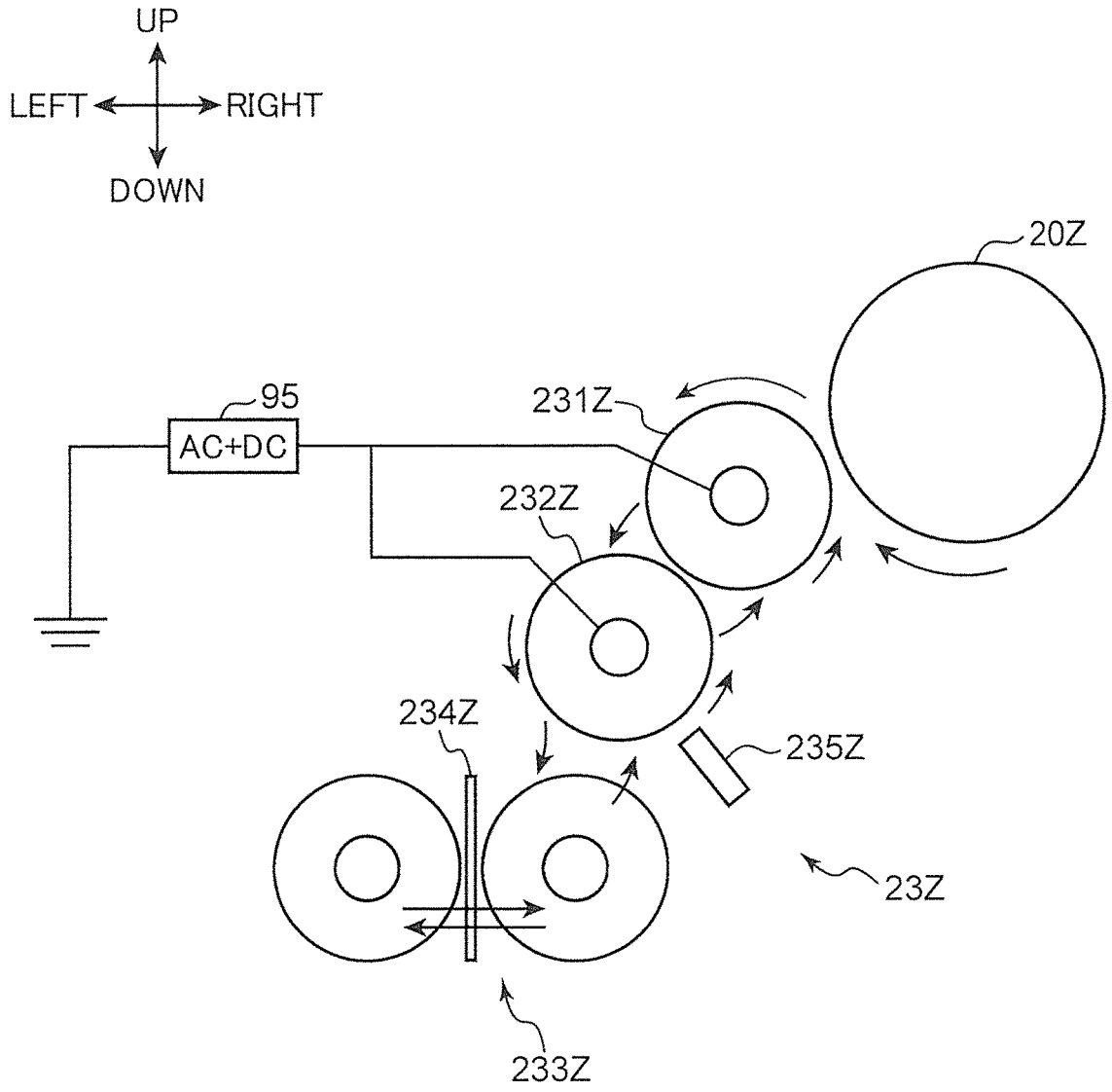
FIG. 14 is a schematic sectional view of another developing device to be compared with the embodiment of the present disclosure.

Note that FIG. 14 is a schematic sectional view of a developing device 23Z used in Experiment 1. In FIG. 14, for members having the same functions as in the above embodiment (FIG. 6), Z is added to the ends of the reference signs of FIG. 6. In the developing device 23Z, a bias applying unit 95 composed of DC and AC power supplies is connected to a developing roller 231Z and a conveyor roller 232Z. In this case, since the developing roller 231Z and the conveyor roller 232Z are constantly at the same potential when development biases are applied, no potential difference is set at the facing position TP. Further, the developing device 23M of FIG. 9 was used in Experiment 2, the developing device 23N of FIG. 10 was used in Experiment 3 and the developing device 23 of FIG. 6 was used in Experiments 4 and 5. Further, an AC bias having the waveform of FIG. 12A was applied between the developing roller 231 and the conveyor roller 232 in Experiment 4, and an AC bias having the waveform of FIG. 12B was applied between the developing roller 231 and the conveyor roller 232 in Experiment 5.

As shown in Table 3, in Experiment 1, no shifting electric field was formed between the developing roller 231Z and the conveyor roller 232Z at the facing position TP. This resulted in the generation of 15 development ghosts. On the other hand, in Experiment 2, development ghosts were more improved than in Experiment 1 since a potential difference of 500 (V) composed of a DC voltage was set between the developing roller 231M and the conveyor roller 232M. Further, in Experiment 3, since Vpp=1200 (V) of an AC voltage and a potential difference of 300 (V) of a DC voltage were set between the developing roller 231N and the conveyor roller 232N, development ghosts were more improved than in Experiment 2. Further, in Experiment 4, since Vpp=1600 (V) of an AC voltage and a potential difference of 300 (V) of a DC voltage were set between the developing roller 231M and the conveyor roller 232M, development ghosts were more improved than in Experiment 3. Further, in Experiment 5, the AC voltage was set to have a duty ratio at which the toner on the developing roller 231 easily moved toward the conveyor roller 232 as compared to Experiment 4. Thus, development ghosts were even more improved than in Experiment 4.

Note that when a gap between the layer thickness regulating member 235 and the second sleeve 232B (blade gap) was adjusted and a similar evaluation was made in a range of not less than 100 g/m2 and not more than 400 g/m2 for the toner conveyance amount on the first sleeve 231B in each of the above experiments, similar results were obtained for a development ghost suppression effect. Further, when an evaluation similar to the above was made in a toner density range of not lower than 5% and not higher than 12% in each of the above experiments, similar results were obtained for the development ghost suppression effect. Further, also when a similar evaluation was made in a range of not shorter than 16 mm and not longer than 35 mm for the diameters of the developing roller 231 and the conveyor roller 232 and in a range of not slower than 200 mm/sec and not faster than 400 mm/sec for the circumferential speed of the photoconductive drum 20, similar results were obtained for the development ghost suppression effect.

Although the developing devices 23, 23M, 23N, 23P and 23Q according to the one embodiment of the present disclosure and the image forming apparatuses 10 provided with these have been described in detail above, the present disclosure is not limited to this. The present disclosure can be, for example, modified as follows.

(1) Although the magnetic pole arrangements of the first and second magnets 231A, 232 are illustrated in the above embodiment, the present disclosure is not limited to this. The first and second magnets 231A, 232B may have other magnetic pole arrangements. Further, each magnetic pole of FIG. 3 may be reversed between S and N poles.

(2) Further, although the layer thickness regulating member 235 is arranged to face the conveyor roller 232 in FIG. 2 in the above embodiment, the present disclosure is not limited to this. The layer thickness regulating member 235 may be arranged to face the developing roller 231.

(3) Furthermore, although the toner has a property of being positively charged in the above embodiment, the present disclosure is not limited to this. The toner may be negatively charged.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developing device, comprising:

a developing roller including a fixed first magnet having a plurality of magnetic poles along a circumferential direction and a first sleeve configured to rotate in a first rotational direction around the first magnet and carry developer containing toner having a predetermined polarity and magnetic carrier on a peripheral surface, arranged to face a photoconductive drum, on a surface of which an electrostatic latent image is to be formed, at a predetermined developing position and configured to supply the toner to the photoconductive drum;

a conveyor roller including a fixed second magnet having a plurality of magnetic poles along a circumferential direction and a second sleeve configured to rotate in a second rotational direction around the second magnet and carry the developer on a peripheral surface, arranged to face the developing roller at a predetermined facing position and configured to supply the developer to the developing roller;

a developer stirring unit configured to stir the developer and supply the developer to the conveyor roller; and a development bias applying unit configured to apply development biases, in each of which an alternating-current bias is superimposed on a direct-current bias, to the first sleeve of the developing roller and the second sleeve of the conveyor roller during a developing operation of developing the electrostatic latent image on the photoconductive drum with the toner;

wherein:

the first and second rotational directions are set to be opposite to each other at the facing position;

the first magnet includes:

a first magnetic pole arranged upstream of the facing position in the first rotational direction; and a second magnetic pole arranged downstream of the facing position in the first rotational direction;

the second magnet includes:

a third magnetic pole arranged to face the second magnetic pole of the first magnet on a side upstream of the facing position in the second rotational direction; and a fourth magnetic pole arranged to face the first magnetic pole of the first magnet on a side downstream of the facing position in the second rotational direction;

the developer supplied from the developer stirring unit to the conveyor roller is transferred from the conveyor roller to the developing roller by a magnetic field formed by the second and third magnetic poles;

the developer having passed through the developing position is transferred from the developing roller to the conveyor roller by a magnetic field formed by the first and fourth magnetic poles; and the development bias applying unit applies the development biases such that a shifting electric field to move the toner on the first sleeve of the developing roller toward the second sleeve of the conveyor roller is formed at the facing position during the developing operation.

2. A developing device according to claim 1, wherein:

an insulating layer is provided on a surface of the second sleeve of the conveyor roller.

3. A developing device according to claim 2, wherein:

the second sleeve includes a base member made of aluminum; and the insulating layer is an alumite layer formed on the base member.

4. A developing device according to claim 1, wherein:

the development bias applying unit forms the shifting electric field by forming a potential difference of a direct-current voltage between the first sleeve of the developing roller and the second sleeve of the conveyor roller.

5. A developing device according to claim 1, wherein:

the development bias applying unit forms the shifting electric field by forming potential differences of a direct-current voltage and an alternating-current voltage between the first sleeve of the developing roller and the second sleeve of the conveyor roller.

6. A developing device according to claim 5, wherein:

the development bias applying unit forms the shifting electric field by applying the alternating-current voltage having a first duty ratio to the first sleeve and applying the alternating-current voltage having a second duty ratio different from the first duty ratio between the first and second sleeves.

7. A developing device according to claim 1, further comprising:

a layer thickness regulating member arranged to face the conveyor roller and configured to regulate a layer thickness of the developer supplied from the developer stirring unit to the conveyor roller.

8. A developing device according to claim 1, wherein:

a gap between the developing roller and the conveyor roller at the facing position is set to be narrower than a gap between the photoconductive drum and the developing roller at the developing position.

9. A developing device according to claim 1, wherein:

a region where the developer is transferred from the conveyor roller to the developing roller by a magnetic field formed by the second and third magnetic poles is arranged at a position at a distance from a region where the toner is moved from the first sleeve of the developing roller to the second sleeve of the conveyor roller by the shifting electric field formed by the development biases applied by the development bias applying unit on the peripheral surfaces of the first and second sleeves; and a region where the developer is transferred from the developing roller to the conveyor roller by a magnetic field formed by the first and fourth magnetic poles is arranged at a position at a distance from the region where the toner is moved from the first sleeve of the developing roller to the second sleeve of the conveyor roller by the shifting electric field formed by the development biases applied by the development bias applying unit on the peripheral surfaces of the first and second sleeves.

10. A developing device according to claim 1, wherein:

the first and fourth magnetic poles are magnetic poles having different polarities; and the second and third magnetic poles are magnetic poles having different polarities.

11. A developing device according to claim 10, wherein:

the first and second magnetic poles are magnetic poles having different polarities.

12. A developing device according to claim 1, wherein:

the first and fourth magnetic poles are magnetic poles having different polarities;

one of the second and third magnetic poles is a magnetic pole having the same polarity as the first magnetic pole; and the other of the second and third magnetic poles is a magnetic pole having a polarity different from the first magnetic pole.

13. A developing device according to claim 12, wherein:

the second magnetic pole is a magnetic pole having the same polarity as the first magnetic pole; and the third magnetic pole is a magnetic pole having a polarity different from the first magnetic pole.

14. An image forming apparatus, comprising:

a developing device according to claim 1;

the photoconductive drum configured to receive the supply of the toner from the developing device and carry a toner image on the peripheral surface; and a transfer unit configured to transfer the toner image from the photoconductive drum to a sheet.

* * * * *